US008618936B2

(12) United States Patent
Niederer, III et al.

(10) Patent No.: US 8,618,936 B2
(45) Date of Patent: Dec. 31, 2013

(54) HEADGEAR AND METHOD OF USING SAME

(75) Inventors: Edward Niederer, III, Houston, TX (US); Robert Eugene Mebane, III, Austin, TX (US)

(73) Assignee: National Oilwell Varco, L.P., Houston, TX (US)

( * ) Notice: Subject to any disclaimer, the term of this patent is extended or adjusted under 35 U.S.C. 154(b) by 271 days.

(21) Appl. No.: 13/072,522

(22) Filed: Mar. 25, 2011

(65) Prior Publication Data

US 2011/0234403 A1 Sep. 29, 2011

Related U.S. Application Data

(60) Provisional application No. 61/318,045, filed on Mar. 26, 2010.

(51) Int. Cl.
*G08B 21/00* (2006.01)

(52) U.S. Cl.
USPC ..... 340/540; 340/600

(58) Field of Classification Search
USPC ..... 340/540
See application file for complete search history.

(56) References Cited

U.S. PATENT DOCUMENTS

| | | | | |
|---|---|---|---|---|
| 3,686,690 | A | 8/1972 | Webb | |
| 3,766,565 | A | 10/1973 | Cozzens | |
| 3,774,239 | A | 11/1973 | Kotzar | |
| 4,097,930 | A | 7/1978 | Bay | |
| 4,333,180 | A | 6/1982 | Bay | |
| 4,575,875 | A | 3/1986 | Dawson et al. | |
| 4,728,173 | A * | 3/1988 | Toth | 349/14 |
| 5,159,720 | A | 11/1992 | Scott, Jr. | |
| D358,006 | S | 5/1995 | Chisolm et al. | |
| 5,495,622 | A | 3/1996 | Kaufman | |
| 5,789,015 | A | 8/1998 | Gupta et al. | |
| 5,829,065 | A | 11/1998 | Cahill | |
| 5,851,585 | A | 12/1998 | Gupta et al. | |
| 5,996,125 | A | 12/1999 | Garzone | |
| 6,442,762 | B1 * | 9/2002 | Neumann | 2/175.7 |
| 6,616,294 | B1 * | 9/2003 | Henry | 362/106 |

(Continued)

FOREIGN PATENT DOCUMENTS

| | | | |
|---|---|---|---|
| CN | 1778215 | A | 5/2006 |
| DE | 3602397 | A1 | 7/1987 |

(Continued)

OTHER PUBLICATIONS

English translation of Abstract for German Patent Application No. 10216378, machine translated from the internet on Jan. 19, 2012, [website: http://depatisnet.dpma.de/DepatisNet/depatisnet?action=bibdat&docid=DE000010216378A1].

(Continued)

*Primary Examiner* — Travis Hunnings
(74) *Attorney, Agent, or Firm* — JL Salazar Law Firm

(57) ABSTRACT

Headgear techniques are provided. The headgear has a crown configured to fit on a wearer's head, a bill extending from the crown with at least a portion of the bill being transparent, and a filtration material positioned about the transparent portion of the bill. The filtration material is reactive to radiant energy whereby radiant energy is selectively permitted to pass therethrough. The filtration material may also be capable of passing electrical signals therethrough. The headgear may be providing with sensors, and be part of a monitoring system.

36 Claims, 8 Drawing Sheets

(56) References Cited

U.S. PATENT DOCUMENTS

| | | | | |
|---|---|---|---|---|
| 6,863,844 | B2 | 3/2005 | Engardio et al. | |
| 6,863,848 | B2 | 3/2005 | Engardio et al. | |
| 6,917,300 | B2 | 7/2005 | Allen | |
| 7,002,744 | B2 | 2/2006 | Evans et al. | |
| 7,176,795 | B2 | 2/2007 | Roed et al. | |
| 7,298,258 | B1 * | 11/2007 | Hudgens et al. | 340/539.13 |
| 7,350,917 | B2 | 4/2008 | Kawai et al. | |
| 7,465,414 | B2 | 12/2008 | Knox et al. | |
| 7,592,911 | B1 | 9/2009 | Hudgens et al. | |
| 7,632,552 | B2 | 12/2009 | Begon et al. | |
| 8,075,133 | B2 * | 12/2011 | Sanchez Ramos | 351/159.57 |
| 2004/0114242 | A1 * | 6/2004 | Sharp | 359/498 |
| 2005/0177928 | A1 | 8/2005 | Moreau et al. | |
| 2006/0215076 | A1 | 9/2006 | Karim | |
| 2007/0000026 | A1 * | 1/2007 | Carr | 2/184.5 |
| 2008/0066218 | A1 | 3/2008 | Loizzo | |
| 2008/0224338 | A1 | 9/2008 | Zinner et al. | |
| 2009/0046244 | A1 * | 2/2009 | Sanchez Ramos | 351/163 |
| 2010/0024096 | A1 | 2/2010 | Arousa | |

FOREIGN PATENT DOCUMENTS

| | | | |
|---|---|---|---|
| DE | 10216378 | A1 | 10/2002 |
| JP | 07096046 | A | 4/1995 |
| JP | 09296319 | A | 11/1997 |
| KR | 20-0345285 | Y1 | 3/2004 |
| WO | 0209545 | | 2/2002 |
| WO | WO02/09545 | | 2/2002 |
| WO | 02/30225 | A1 | 4/2002 |
| WO | WO02/39839 | | 5/2002 |

OTHER PUBLICATIONS

PCT International Search Report and Written Opinion for Counterpart PCT Patent Application No. PCT/US2011/030004, dated Dec. 23, 2011, 11 pages.

International Preliminary Report on Patentability from counterpart PCT Patent Application No. PCT/US2011/030004, Oct. 2, 2012, 6 pages.

Hard Cap Model HC6P-CLR-S Datasheet [online]. Oberon Company, 2012 [retrieved on Nov. 8, 2012]. Retrieved from the Internet: <URL: http://www.oberoncompany.com/products/HC6P-CLR-S>.

Hard Cap Model HC6A-CLR-R Datasheet [online]. Oberon Company, 2012 [retrieved on Nov. 8, 2012-]. Retrieved from the Internet: <URL: http://www.oberoncompany.com/products/HC6A-CLR-R>.

Hard Cap Model HC6A-CLR-S Datasheet [online]. Oberon Company, 2012 [retrieved on Nov. 8, 2012]. Retrieved from the Internet: <URL: http://www.oberoncompany.com/products/HC6A-CLR-S>.

Hard Cap Model HC6P-CLR-R Datasheet [online]. Oberon Company, 2012 [retrieved on Nov. 8, 2012]. Retrieved from the Internet: <URL: http://www.oberoncompany.com/products/HC6P-CLR-R>.

Centurion Head Protection & Accessories. Centurion Safety Products Ltd., 16pp., 2009.

Kukje Safety Co., Ltd. Product brochure [online]. Kukje Safety Co., Ltd., 2011 [retrieved on Jul. 26, 2013]. Retrieved from the Internet: URL: http://www.kukjesafety.co.kr/bbs/list.php? &bbs_id=eng_pro_gall&page=1&doc_num=25.

* cited by examiner

HEADGEAR AND METHOD OF USING SAME

CROSS REFERENCE TO RELATED APPLICATION

This application is a non-provisional of U.S. Provisional Application No. 61/318,045 filed Mar. 26, 2010, the entire contents of which are hereby incorporated by reference.

BACKGROUND OF THE INVENTION

1. Field of the Invention

The present invention relates generally to equipment for personnel. In particular, the present invention relates to headgear, such as safety hard hats, for personnel.

2. Background of the Related Art

Personnel are often provided with equipment, such as headgear, for protection in the workplace. For example, safety helmets (or hard hats) may be standard equipment in industries where people need protective gear for their heads (e.g., construction sites). In another example, occupational headgear may involve applications designed to protect the eyes using shields, such as in the medical and research fields. In some cases, the safety headgear may be provided with various features and attachments.

The basic hard hat design typically has a crown and a bill. In some cases, hard hats may be configured with opaque bills extending from the crown to shade the wearer's eyes. Certain hard hats have been configured with transparent brims (or bills) as described in U.S. Pat. Nos. 5,996,125, 20100024096, 20080066218, and PCT Application No. WO 02/09545. Hard hats have also been provided with various accessories or options as described in US Patent/Application Nos. U.S. Pat. Nos. 3,766,565, 7,176,795, 5,829,065, 7,592,911, 7,298,258, 6,616,294, 20060215076 and 2005/0177928.

The use of protective headgear, such as hardhats, continues to increase as safety regulations are further implemented throughout industries. Despite the advancements in hardhat technology, there remains a need for advanced headgear techniques for enhancing safety of the user. It is desirable to provide headgear that enhances visibility. It is further desirable to provide headgear that further protects the wearer. The present invention is directed to fulfilling these needs in the art.

SUMMARY OF THE INVENTION

In at least one aspect, the present invention relates to a headgear having a crown configured to fit on a wearer's head, a bill extending from the crown with at least a portion of the bill being transparent, and a filtration material. The filtration material is positioned about the transparent portion of the bill. The filtration material is reactive to radiant energy whereby radiant energy is selectively permitted to pass therethrough.

At least a portion of the crown may be transparent with the filtration material positioned about the transparent portion of the crown. The filtration material may become opaque (for example, 50-100% opaque) upon exposure to radiant energy. The filtration material may be configured to darken when exposed to radiant energy. The radiant energy may be one of natural light, artificial light, UV rays, heat and combinations thereof. The filtration material may be photoelectric and/or photochromic.

The headgear may also have at least one sensor in an interior of the crown. The filtration material may permit the passages of electrical signals therethrough. The sensor(s) may be an RFID tag, a gauge, a transceiver and/or an alarm.

The crown may have at least one vent therethrough. The bill may extend over a neck of the wearer. The headgear may have a neck support, a flap, a lanyard, a light and/or a basket.

In another aspect, the invention relates to a headgear monitoring system. The headgear monitoring system has at least one headgear and at least one controller in communication with the sensor. The headgear includes a crown configured to fit on a wearer's head, a bill extending from the crown with at least a portion of the bill being transparent, at least one sensor in an interior of the crown, and a filtration material. The filtration material is positioned about the transparent portion of the bill. The filtration material is reactive to radiant energy whereby radiant energy is selectively permitted to pass therethrough. The filtration material may be capable of passing electrical signals therethrough.

The system may have an alarm, at least one onsite and/or offsite controller. The controller may have a processer, a transceiver, a display, and a memory.

In yet another aspect, the present invention relates to a method of monitoring. The method involves providing at least one wearer with a headgear, establishing a communication link between the sensor and a controller, and collecting data from the sensor. The communication link extends through the headgear. The method may also involve passing electrical signals between the sensors of a plurality of headgear, determining a location of the wearers, selectively activating an alarm, analyzing the data, and/or sending feedback based on the analyzed data.

Finally, in yet another aspect, the present invention may relate to a method of manufacturing a headgear. The method involves producing a crown configured to fit over a wearer's head, the crown having a bill extending therefrom with at least a portion of the bill being transparent, and providing the transparent portion of the bill with a filtration material. The method may also involve applying the filtration material on at least a portion of the bill and/or integrating the filtration material into the transparent portion of the bill.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are, therefore, not to be considered limiting of its scope, for the invention may admit to other equally effective embodiments. The figures are not necessarily to scale, and certain features and certain views of the figures may be shown exaggerated in scale or in schematic in the interest of clarity and conciseness.

DETAILED DESCRIPTION OF THE INVENTION

Presently preferred embodiments of the invention are shown in the above-identified figures and described in detail below. Embodiments are described with reference to certain features and techniques for headgear. As such, depicted embodiments focus on advantages, such as protection and/or increased visibility, made available by the use of filtration materials with the headgear.

Figure 1:
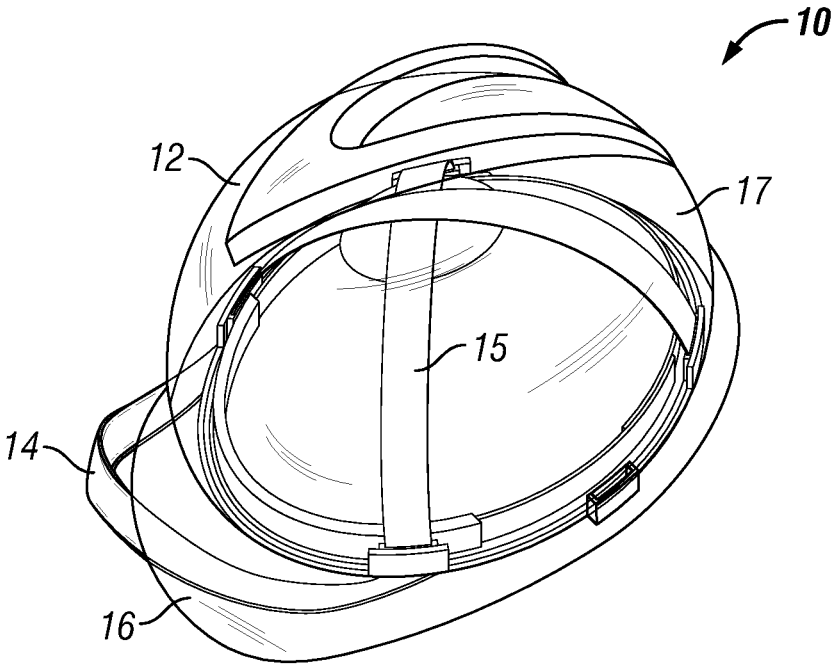
FIGS. 1 and 2 are schematic views of a headgear according to the invention.
Figure 2:
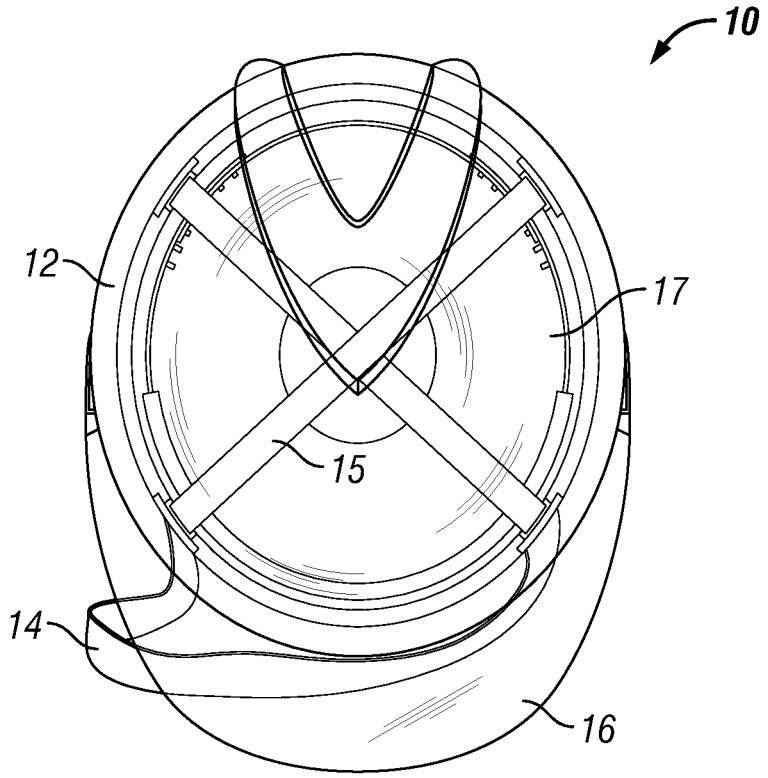

FIG. 1 shows an aspect of the headgear 10 of the invention. FIG. 2 shows another view of the headgear 10 of FIG. 1. It will be understood that the term 'headgear' herein encompasses hats, helmets, caps, and other articles worn on the head. The headgear 10 of FIGS. 1 and 2 as depicted is a hard hat usable, for example, to protect a wearer's head.

The headgear 10 is configured with a crown 12, a strap 14, a basket 15, a bill 16 and a filtration material 17. The crown 12 is configured to receive a wearer's head. The bill 16 extends from the front of the crown 12 over the wearer's eyes and/or face. One or more straps 14 may extend from the crown 12 and wrap around the wearer for securing the headgear 10 in position on the wearer. The basket 15 may be positioned on an inner surface of the crown 12 for supporting the headgear 10 on the wearer's head. The basket 15 may provide a cushion for holding the crown 12 a distance from the wearer's head. The straps 14 may also be disposed on the headgear 10 using any suitable means known in the art. For example, the straps 14 may be connected to the crown 12 and/or the basket 15. Conventional materials may be used for the straps 14 and basket 15, along with fastener hardware as known in the art.

The headgear 10 shown in FIGS. 1 and 2 may be formed as a one-piece (or unitary) unit, such as a hard hat. In the configuration as shown, the bill 16 extends outward from a front portion of the crown 12 in a unitary piece. Other headgear 10 aspects of the invention may be implemented using one or more separate pieces. For example, the crown 12 may be separate from the bill 16. Portions of the headgear, such as the bill 16 and the crown 12, may be coupled via any suitable means known in the art (e.g., adhesives, heat fusing, fasteners, etc.).

The headgear 10 of FIGS. 1 and 2 is depicted as being transparent. Aspects of the headgear 10 can be formed using conventional materials (e.g., synthetic compounds, resins, composites, plastics, etc.) providing the transparency properties. The headgear 10 may be formed using a material providing desired transparency under certain lighting conditions, such as indoor lighting. Thus, when worn in such lighting, a wearer's head can be seen through the headgear 10, and/or the wearer may be able to see through the headgear thereby increasing visibility.

The filtration material 17 may selectively permit the passage of, for example, light, heat and/or other radiant energy therethrough. The filtration material 17 may be integral with the crown 12 and/or bill 16, or adhered thereto. The filtration material 17 may be positioned about the entire headgear 10, or a portion thereof. Aspects of the headgear 10 may be implemented with the crown 12 and bill 16 configured, for example, with a filtration material 17 for selectively providing radiant-energy-reactive ("RER") properties, such as transparency and filtration, as will be described further herein.

Figure 3:
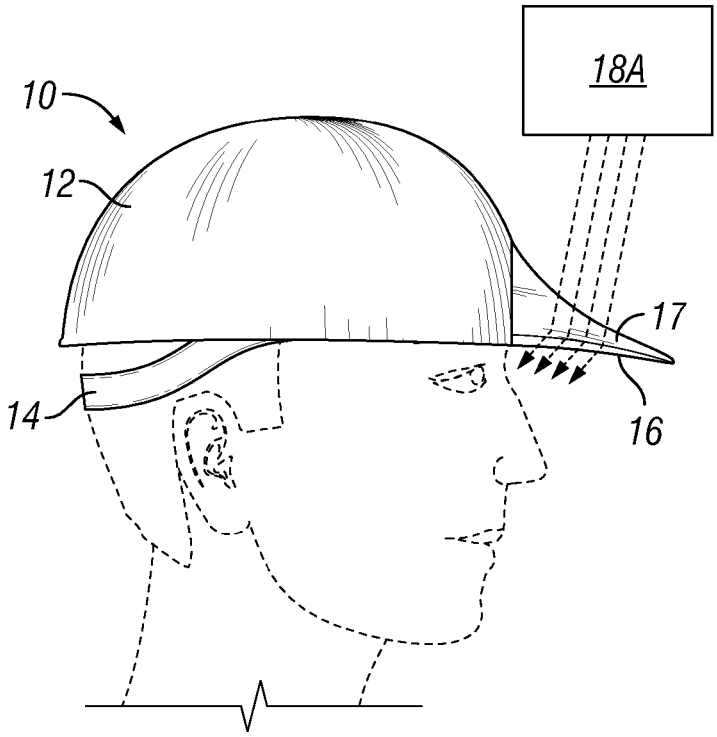
FIGS. 3 and 4 are schematic views of the headgear of FIG. 1 exposed to radiant energy.
Figure 4:
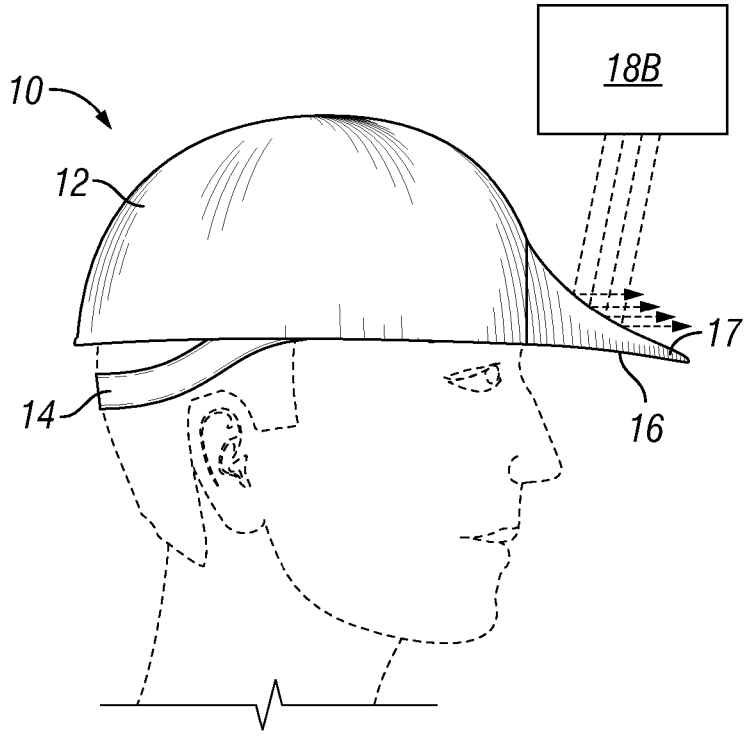
Figure 8:
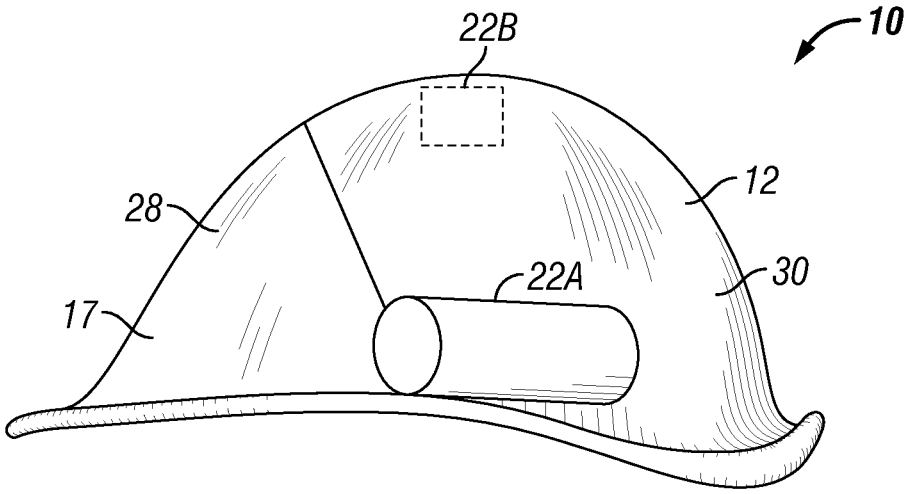
FIGS. 8 and 9 are schematic views of a various configurations of a headgear having opaque and transparent portions.
Figure 9:
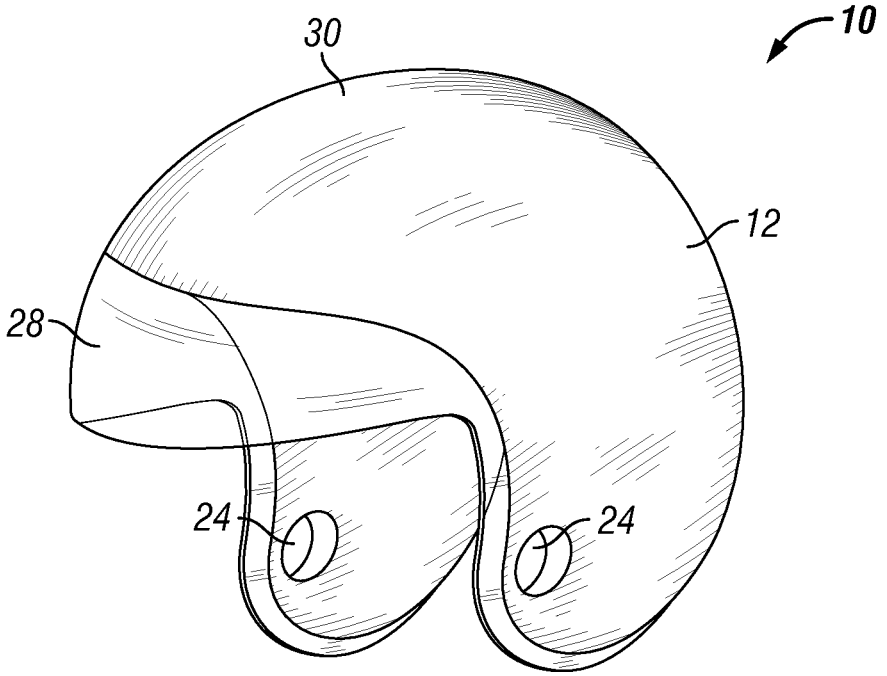

Various portions of the headgear 17 may be configured for providing the RER property. Some versions of the headgear 10 may be configured with both the crown 12 and the bill 16 having the filtration material 17 as shown in FIGS. 1 and 2. Other versions may be configured with only a portion of the headgear having the filtration material 17, such as the bill 16 as shown in FIGS. 3 and 4. Yet other embodiments may be configured with certain portions or segments of the crown 12 and/or bill 16 having the filtration material 17 as shown in FIGS. 8 and 9 as will be described further below.

Referring still to FIGS. 3 and 4, the filtration material 17 may be provided with various filtration properties for selectively permitting the passage of radiant energy therethrough. The filtration material 17 may be used, for example, to protect the wearer's skin and/or eyes from exposure to heat and/or light (or other radiant energy). As shown in FIG. 3, the bill 16 may be exposed to radiant energy in the form of artificial light **18*a* that is permitted to pass through the bill 16 as indicated by the arrows. As shown in FIG. 4, the bill 16 may be exposed to radiant energy 18*b* in the form of UV rays 18*b* that is reflected from the bill 16 as indicated by the arrows. As demonstrated in FIGS. 3 and 4, the filtration material may be radiant-energy-reactive ("RER") and/or have polarizing properties (e.g., photochromic, photoelectric, etc.) to selectively filter light, such the UV rays as shown in FIG. 4**.

Headgear 10 embodiments may also be configured with polarizing or other RER materials to provide protection against radiant energy (e.g., UV rays and/or glare) while providing the desired transparency and RER property as shown in FIGS. 3 and 4. For example, aspects of the headgear 10 may be provided with filtration material 17 configured to react to specific radiant energy, such as to provide filtering against harmful UV rays, while providing the desired transparency under other conditions. The bill 16 may react to the radiant energy such that the bill 16 selectively becomes opaque upon receipt of certain radiant energy, such as UV rays. In such cases, the bill 16 may darken to prevent the passage of radiant energy therethrough.

Aspects of the headgear 10 of the invention may be configured to provide desired transparency under certain lighting conditions and opaqueness under other lighting conditions. For example, where the material reacts to radiant energy, the color of the headgear 10 may adjust from light to dark thereby appearing opaque. The transparency of the bill 16 may selectively be adjusted based on the amount of radiant energy received. For example, the bill 16 may react to radiant energy to become 50% opaque, or prevent 50% of the light to pass through. The amount of opacity may increase as radiant energy increases. Preferably, the filtration material 27 adjusts to optimize the wearer's visibility and protection.

The filtration material 17 may be made of various materials. For example, some aspects of the invention may be implemented using conventional substances, such as photochromic resins providing photochromic (e.g., light sensitive, light filtering, automatic darkening, etc.) properties. Techniques for producing photochromic resins are described in U.S. Patent Application No. 20080224338. U.S. Pat. Nos. 7,465,414, 6,863,848, 6,863,844, 5,851,585, and 5,789,015 also describe techniques for producing photochromic articles and substances. In another example, the filtration material 17 may be created using polarizing techniques. U.S. Pat. Nos. 7,632,552, 7,350,917, and 7,002,744 describe techniques for producing polarizing articles and materials.

Conventional materials and fabrication techniques may be used to implement the headgear 10 aspects of the invention. For example, the hard hat embodiment of FIGS. 1-4 may be formed via conventional injection molding, casting, thermosetting, curing techniques, etc. In some aspects, the headgear 10 is formed with the RER/polarizing substance(s) introduced or loaded during production of the headgear piece(s). In other aspects, the compounds or substances providing the RER and/or polarizing properties may be combined with or added to base substances to produce the desired transparency-darkening in the headgear. Some headgear 10 aspects may be implemented with a conventional polarizing film disposed on a surface of the crown/bill. Other aspects may be implemented with RER/polarizing compounds or films disposed as layers or laminations to form the headgear 10. In some cases, the filtration material may be painted onto the headgear 10, or made integral with the body of the headgear 10.

Figure 5A:
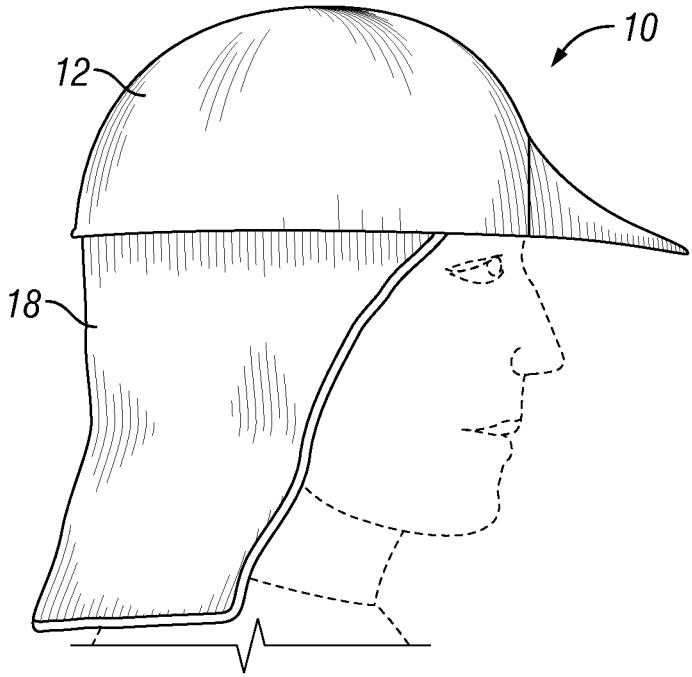
FIGS. 5A and 5B are schematic views of a headgear having an internal and external flap, respectively.
Figure 5B:
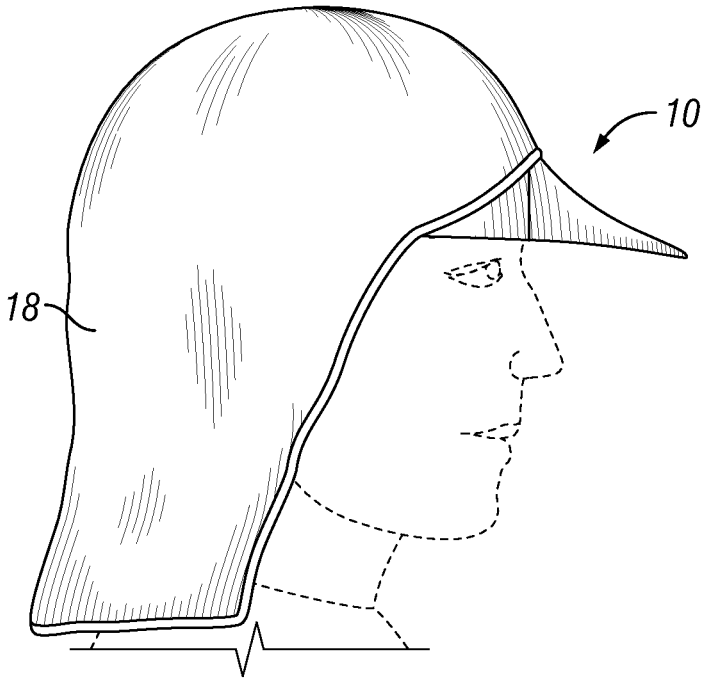

The headgear 10 of the invention may be implemented with various features, such as a flap as shown in FIGS. 5A and 5B. FIG. 5A shows a headgear aspect including an internal flap 18 extending from the lower portion of the crown 12. With this example, the configuration is used to provide additional protection from the elements or harmful debris for the wearer's ears, neck, and shoulders. The flap 18 may extend into the crown and over the wearer's head, for example, to absorb sweat. The flap 18 (or other material) may optionally be positioned on top of the headgear 10 to act as a bonnet (or cover) as shown in FIG. 5B. In this configuration, the external flap 18 is positioned over the headgear 10, for example as a half bonnet, such that portions, such as a transparent portion, of the headgear 10 may remain exposed as desired. The flap 18 may optionally be positioned over the transparent portions of the headgear 10, if desired.

Any suitable material may be used for the flap 18, such as microfiber. The flap 18 may optionally be attached to the crown 12 or straps 14 with conventional fasteners to allow for easy removal as desired. The headgear 10 and/or flap 18 may be provided with various colors, textures, markers or other designs for identification and/or aesthetic purposes.

Figure 6:
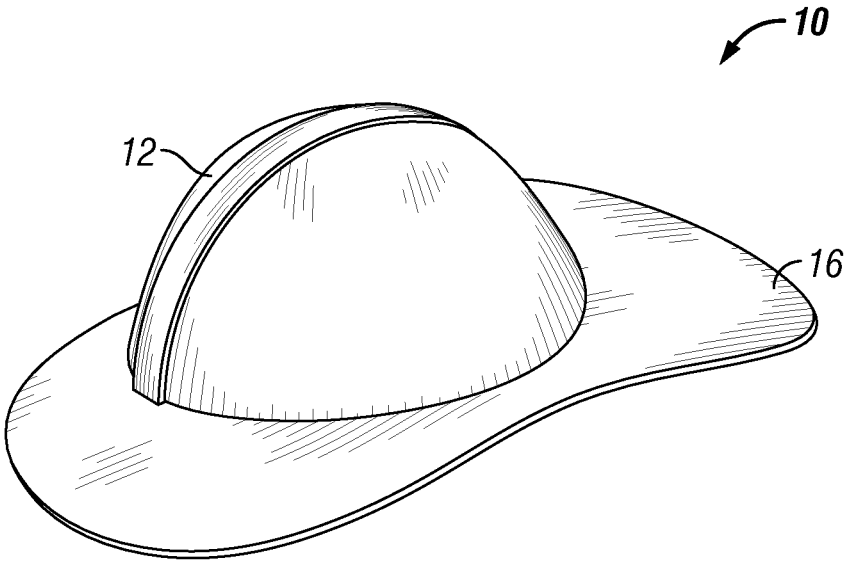
FIG. 6 is a schematic view of a headgear having an extended bill.

In another example, FIG. 6 shows an aspect of the headgear 10 formed with a bill 16 extending outward about the circumference of the crown 12. With this example, the hard material of the bill 16 extends over the wearer's ears, neck, and shoulders to provide additional protection from the elements or harmful debris. This configuration may be similar to a fireman's helmet having an extended bill for protecting the wearer from falling debris. The bill 16 and/or crown 12 may define a neck support extending from the rear and/or provided with padding or other features to support the wearers head and neck, for example, during a rear impact.

Figure 7:
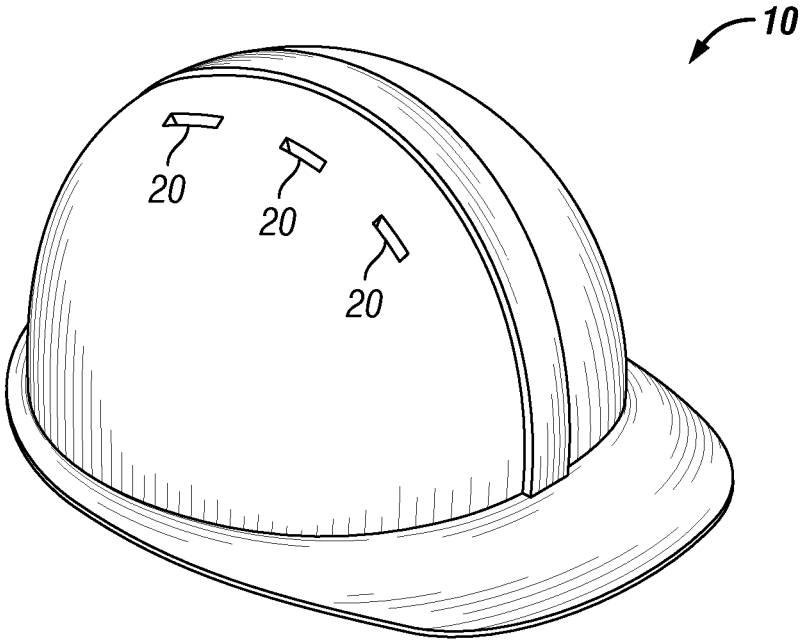
FIG. 7 is a schematic view of the headgear of FIG. 1 having vents therein.
Figure 10:
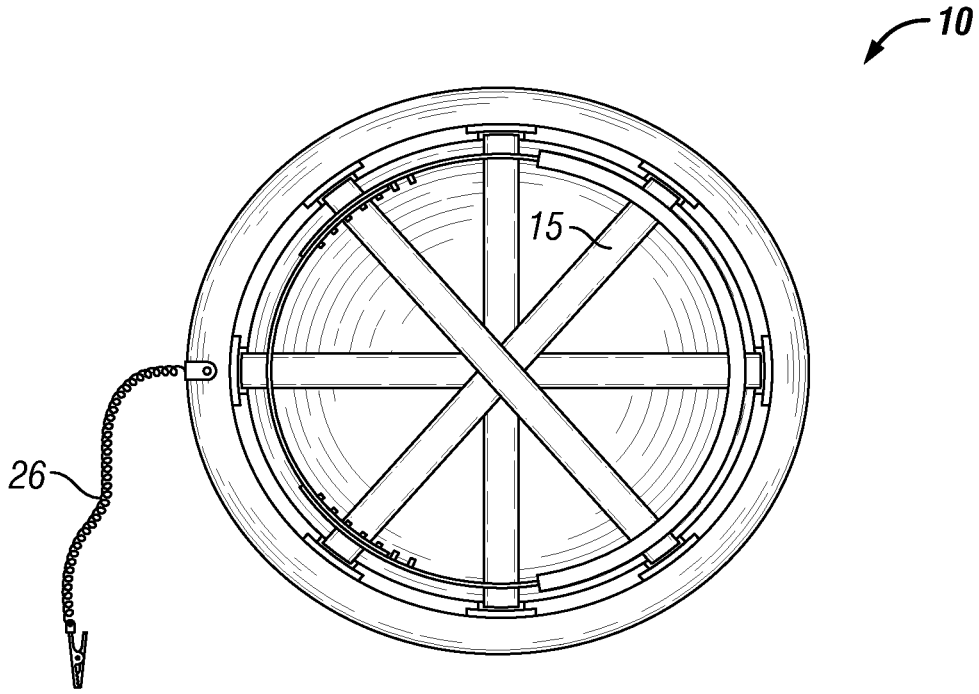
FIG. 10 is a schematic view of an interior of a headgear.

In yet another example, other aspects of the headgear 10 may be implemented with apertures or vents 20 to provide ventilation to the wearer's head, as shown in FIG. 7. In this example, three vents 20 are positioned through the crown to permit the passage of air therethrough. The vents may be used to provide breathability through the crown 12 for the comfort of the wearer. As shown in FIG. 8, one or more lights may be positioned outside or inside of the headgear 10. In one example, the light 22 may be an LED light positioned inside the headgear 10 and visible through the transparent crown 12 for providing illumination for the wearer (e.g., in places where a flashlight may not fit), for identifying the wearer, and/or for locating the wearer. The headgear 10 may also be provided with other accessories or options (or other features), such as holes 24 as depicted in FIG. 9, and/or a lanyard 26 as depicted in FIG. 10. The headgear 10 may also be provided with a clip for goggles (or eyewear). For example, the goggles may be separate from the headgear and fastened with the clip.

As shown in FIGS. 6 and 9, the shape of the headgear 10 may vary. The crown 12 and/or bill 16 may be adjusted to provide a desired shape capable of protecting the wearer. In some cases, such as the headgear of FIG. 5, the shape is configured to protect portions of the wearer, such as the neck or back of the head. One or more bills 16 may extend from various portions of the crown a distance sufficient to further shield the wearer. In other cases, such as the helmet of FIG. 6, the shape of the crown 12 may be configured for protection or comfort of the wearer during certain activities, such as sports. In the configuration of FIG. 6, the headgear 10 has an extended bill 16 to shield the neck of the wearer. The back of the headgear 10 may optionally be provided with additional neck support or padding to support the wearer, such as the extended crown 12 as shown in FIG. 8. As shown in FIG. 9, the crown 12 extends over the wearer's ears and is provided with holes 24 to facilitate hearing through the headgear 10. As shown in the interior view of the headgear 10 of FIG. 8, the basket 15 may be provided with padding to protect the wearer.

As further shown in FIGS. 8 and 9, at least part of the headgear 10 may optionally remain opaque. The headgear 10 of FIGS. 8 and 9 is provided with a transparent portion 28 and an opaque portion 30. The opaque portions 30 of the headgear 10 may be made of an opaque material, or have a material, such as paint, applied thereto. To achieve the desired configuration, it may be necessary to perform one or more molds (e.g., injection molding) of one or more materials. The transparent portion 28 may be provided with the filtration material 17 as previously described. One or more portions of the headgear 17 may selectively be transparent or opaque. The filtration material 17 may react to radiant energy to selectively adjust the transparent portion 28 to provide opacity as previously described.

As also shown in FIGS. 8 and 9, the shape of the headgear may be adapted for visibility or protection for the user. For example, the transparent portion 28 may have an extended (or bill) shape as shown in FIG. 8 or a flat (or shield) shape as shown in FIG. 9. The shape of the bill 12 may be configured to shield the wearer's eyes from overhead, frontal or other light and/or projectiles.

Figure 11:
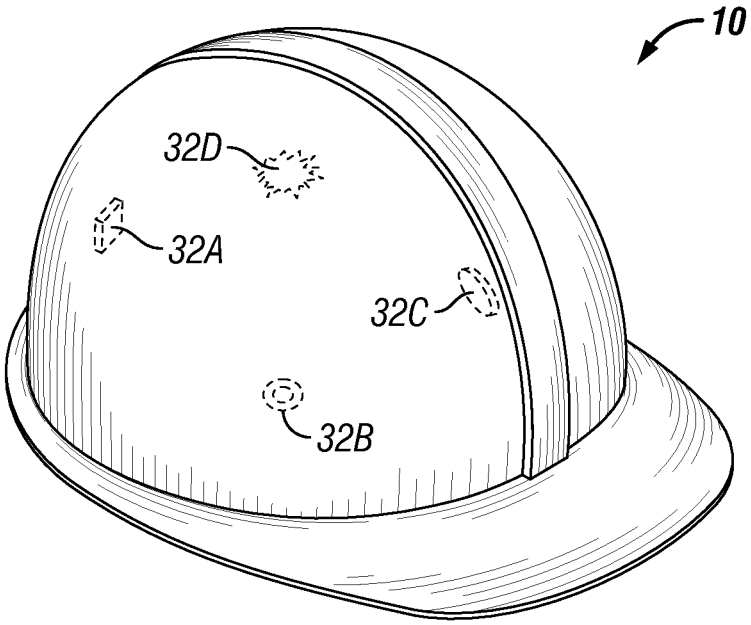
FIG. 11 is a schematic view of a headgear provided with sensors.

The headgear 10 may also be provided with various sensors, such as the sensors 32*a-d* of FIG. 11, for performing various functions. The sensors are positioned in an interior of the headgear 10. The sensors may be any electronics used performing monitoring functions, such as an RFID tag (or chip) 32*a*, a gauges (e.g., temperature) 32*b*, a transceiver 32*c*, and/or an alarm 32*d*. The RFID tag 32*a* may be a conventional RFID device containing various information about the wearer and/or the wearer's location. The gauge 32*b* may be used to measure various site parameters, such as noise levels, harmful and/or odorless gases (e.g., carbon monoxide, hydrogen sulfide or natural gas (with or without odor)), temperature, radiation, toxic exposure, chemicals, gases, etc. The transceiver 32*c* may be used for communication with other electrical devices. The alarm 32*d* may be a sound, light, flashes (one or more colors), vibration, beeping or other device used to alert the wearer, or others monitoring the wearer or the wearer's facility. For example, if a dangerous level of gas, heat, etc. is encountered, a light may begins to flash. Different color flashes or various beeps may be used to mean different hazards. In cases where loud noise levels surround the wearer or where the wearer may wear earplugs, a visual register, such as the color flashes may be used.

Figure 12:
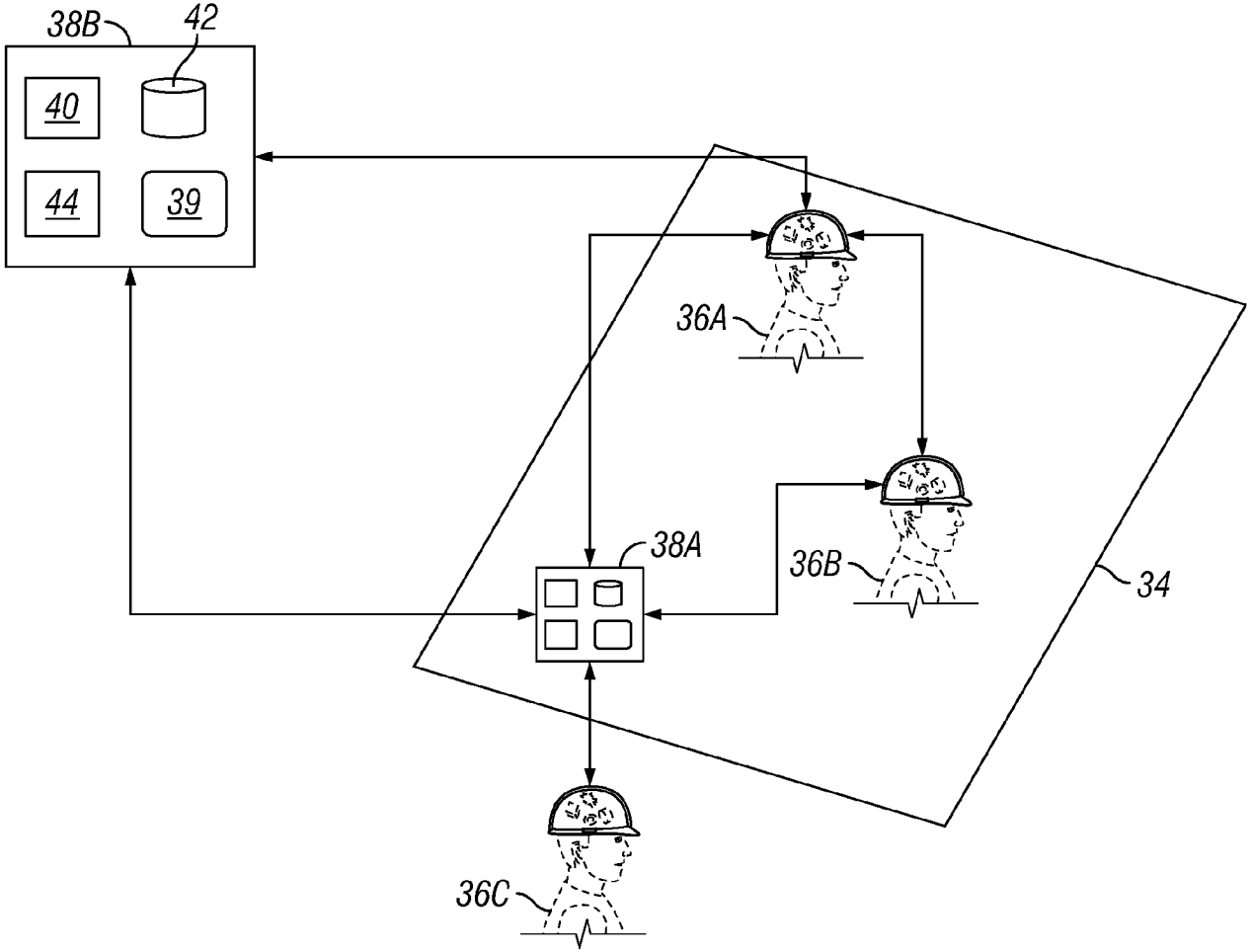
FIG. 12 is a schematic view of a headgear monitoring system.

FIG. 12 is a schematic view of a facility 34 having wearers 36*a-c* positioned thereabout. Wearers 36*a* and 36*b* are positioned onsite at the facility. Wearer 36*c* is positioned offsite from the facility. Each of the wearers 36*a-c* is wearing a headgear 10 provided with sensors 32*a-d* as shown in FIG. 11. Onsite controller 38*a* and offsite controller 38*b* are also provided. The controllers 38*a-b* may be provided with transceivers 39 for communication with each other and/or with the sensors 36*a-d*. As shown, sensors 36*a-c* are all in communication with onsite controller 38*a*, sensors 36*a* and 36*b* are in communication with each other, and sensors 36*a* and 36*c* are in communication with offsite controller 38*b*.

The sensors 32*a-d* are depicted in the interior of the headgear 10. In this configuration, the sensors 32*a-d* are protected within the crown 12 in a space between the crown 12 and the wearer's head. The headgear 10 and filtration material 17 may be made of materials that permit the passage of electrical signals, such as communication signals therethrough. Alternatively, the sensors 32*a-d* may be positioned in portions of the headgear 10 that are not covered with filtration material 17.

The controllers 38*a-b* may be provided with a processor 40, a memory 42, a display 44, software (not shown) and/or other computer equipment for receiving and processing data. The wearer's 36*a-d* may also be provided with mobile controllers that may be wirelessly (or wired) to the sensors 32*a-d* of the headgear 10. For example, the controller may be a wireless (or wired) monitor/dashboard that may be clipped to the wearer. Alarms, such as a light, flash, sound, or vibration may be used to alert the wearer and can be seen by the wearer in peripheral vision below.

Figure 13:
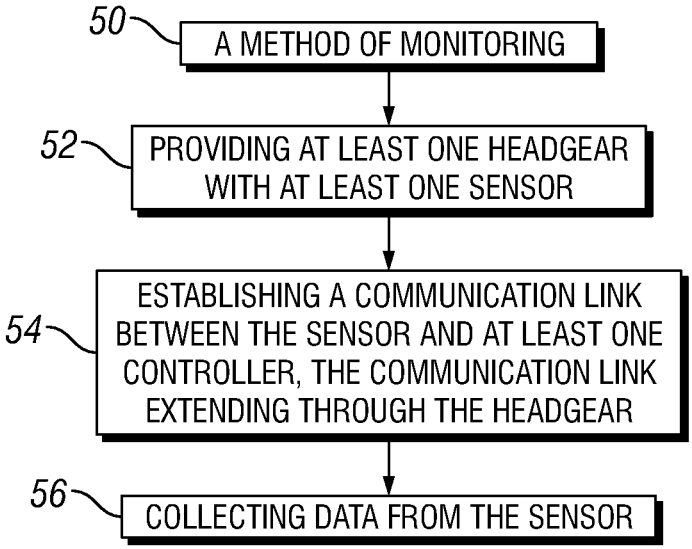
FIG. 13 is a flowchart depicting a method of monitoring.
Figure 14:
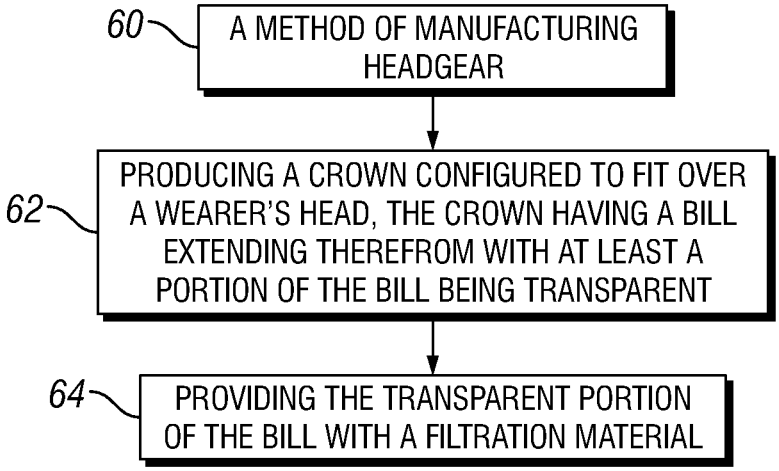
FIG. 14 is a flowchart depicting a method of manufacturing.

As shown in FIG. 13, the controllers may be used to implement a method 50 for monitoring the headgear 10 (and/or the wearer's 36*a-c*). The method may involve providing (52) at least one headgear with at least one sensor; establishing (54) a communication link between the sensor and at least one controller, the communication link extending through the headgear; and collecting (56) data from the sensor.

The method may further involve passing electrical signals (e.g., communication signals) between the sensors 32*a-d* of a plurality of headgear 10, determining a location of the at least one wearer, selectively activating an alarm, analyzing data, sending feedback based on the analyzed data and/or other steps as desired. Alarms 32*b* may be activated when the sensor approaches a predetermined location, such as the edge of the facility or an unauthorized area. The data may be analyzed to determine various parameters, such as manning, conditions of the facility and/or wearer, etc. The controllers 38*a-b* may be used to provide feedback to on or offsite facility personnel. Data may be analyzed and presented on the displays. Other monitoring steps may be taken as described in U.S. Pat. No. 7,298,258. The steps may be performed in any order as desired.

A method (60) may also be provided for manufacturing the headgear 10. The method 60 may involve producing (62) a crown configured to fit over a wearer's head, the crown having a bill extending therefrom with at least a portion of the bill being transparent; and providing (64) the transparent portion of the bill with a filtration material. The method (60) may also involve applying a filtration material 17 on the transparent portion of the bill 16 (and/or crown 12) and/or integrating the filtration material 17 into the transparent portion of the bill 16 (and/or crown 12) while performing the step of producing. For example, the headgear 10 may be produced by injection molding plastic with filtration material 17 incorporated therein.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the present disclosure describes specific aspects of the invention, numerous modifications and variations will become apparent to those skilled in the art after studying the disclosure, including use of equivalent functional and/or structural substitutes for elements described herein. For example, while certain embodiments have been described, modifications thereof can be made by one skilled in the art without departing from the scope or teachings herein. For example, aspects of the invention may be implemented with a combination of transparent and opaque (or colored) areas as desired. Yet other embodiments may be implemented incorporating additional components (e.g., lamps, reflectors, etc.) depending on the particular use/application of the headgear. It will be understood by those skilled in the art that the headgear aspects of the invention are not limited to any particular type of hat or head covering. Many variations and modifications of the headgear are possible and are within the scope of the invention.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A headgear, comprising:

a crown configured to fit on a wearer's head;

a bill extending from the crown, at least a portion of the bill being transparent; and a filtration material positioned about the transparent portion of the bill, the filtration material reactive to radiant energy whereby radiant energy is selectively permitted to pass therethrough.

2. The headgear of claim 1, wherein at least a portion of the crown is transparent, the filtration material positioned about the transparent portion of the crown.

3. The headgear of claim 1, wherein the filtration material becomes opaque upon exposure to radiant energy.

4. The headgear of claim 1, wherein the filtration material becomes 50% opaque upon exposure to radiant energy.

5. The headgear of claim 1, wherein the filtration material is configured to darken when exposed to radiant energy.

6. The headgear of claim 1, wherein the radiant energy is one of natural light, artificial light, UV rays, heat and combinations thereof.

7. The headgear of claim 1, wherein the filtration material is one selected from the group of photoelectric, photochromic, and combinations thereof.

8. The headgear of claim 1, further comprising at least one sensor in an interior of the crown.

9. The headgear of claim 8, wherein the filtration material permits the passage of electrical signals therethrough.

10. The headgear of claim 8, wherein the at least one sensor comprises an RFID tag.

11. The headgear of claim 8, wherein the at least one sensor comprises a gauge.

12. The headgear of claim 8, wherein the at least one sensor comprises a transceiver.

13. The headgear of claim 8, wherein the at least one sensor comprises an alarm.

14. The headgear of claim 1, wherein the crown has at least one vent therethrough.

15. The headgear of claim 1, further comprising a flap positionable over at least a portion of the headgear.

16. The headgear of claim 1, further comprising a neck support.

17. The headgear of claim 1, further comprising a lanyard.

18. The headgear of claim 1, further comprising at least one light in an interior of the headgear, the at least one light for projecting light through the transparent portion.

19. The headgear of claim 1, further comprising a basket.

20. A headgear monitoring system, comprising:

at least one headgear, comprising:

a crown configured to fit on a wearer's head;

a bill extending from the crown, at least a portion of the bill being transparent;

at least one sensor in an interior of the crown; and a filtration material positioned about the transparent portion of the bill, the filtration material capable of passing electrical signals therethrough, the filtration material reactive to radiant energy whereby radiant energy is selectively permitted to pass therethrough; and at least one controller in communication with the at least one sensor.

21. The headgear monitoring system of claim 20, further comprising an alarm.

22. The headgear monitoring system of claim 20, wherein the at least one controller is onsite.

23. The headgear monitoring system of claim 20, wherein the at least one controller is offsite.

24. The headgear monitoring system of claim 20, wherein the at least one controller comprises a processer, a transceiver, a display, and a memory.

25. A method of monitoring, comprising:

providing at least one wearer with a headgear, each of the headgear comprising:

a crown configured to fit on a wearer's head;

a bill extending from the crown, at least a portion of the bill being transparent; at least one sensor in an interior of the crown; and a filtration material positioned about the transparent portion of the bill, the filtration material capable of passing electrical signals therethrough, the filtration material reactive to radiant energy whereby radiant energy is selectively permitted to pass therethrough; and establishing a communication link between the at least one sensor and at least one controller, the communication link extending through the at least one headgear; and collecting data from the at least one sensor.

26. The method of claim 25, further comprising passing electrical signals between the at least one sensors of a plurality of headgear.

27. The method of claim 25, further comprising determining a location of the at least one wearer.

28. The method of claim 25, further comprising selectively activating an alarm.

29. The method of claim 25, further comprising analyzing the data.

30. The method of claim 29, further comprising sending feedback based on the analyzed data.

31. The method of claim 25, further comprising measuring site parameters.

32. A method of manufacturing a headgear, comprising:

producing a crown configured to fit over a wearer's head, the crown having a bill extending therefrom, at least a portion of the bill being transparent; and providing the transparent portion of the bill with a filtration material adjustably reactive to radiant energy whereby radiant energy is selectively permitted to pass therethrough.

33. The method of claim 32, wherein the providing comprises applying the filtration material on at least a portion of the bill.

34. The method of claim 32, wherein the providing comprises integrating the filtration material into the transparent portion of the bill.

35. The headgear of claim 1, wherein the filtration material is applied to at least a portion of the bill.

36. The headgear of claim 1, wherein the filtration material is integrated into the transparent portion of the bill.

* * * * *